US011530882B2

(12) United States Patent
Sus et al.

(10) Patent No.: US 11,530,882 B2
(45) Date of Patent: Dec. 20, 2022

(54) FRAME FOR A HEAT EXCHANGER

(71) Applicant: Valeo Autosystemy Sp. z o.o., Skawina (PL)

(72) Inventors: Pawel Sus, Bietigheim-Bissingen (DE); Mateusz Kaczmarczyk, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 58 days.

(21) Appl. No.: 16/638,536

(22) PCT Filed: Aug. 14, 2018

(86) PCT No.: PCT/EP2018/071995
§ 371 (c)(1),
(2) Date: Feb. 12, 2020

(87) PCT Pub. No.: WO2019/034639
PCT Pub. Date: Feb. 21, 2019

(65) Prior Publication Data

US 2020/0217600 A1 Jul. 9, 2020

(30) Foreign Application Priority Data

Aug. 17, 2017 (EP) ..... 17461591

(51) Int. Cl.
*F28F 9/00* (2006.01)
*F28D 1/04* (2006.01)
(Continued)

(52) U.S. Cl.
CPC ..... *F28F 9/001* (2013.01); *F28D 1/0435* (2013.01); *F28D 1/05366* (2013.01);
(Continued)

(58) Field of Classification Search
CPC ..... F28F 9/001; F28F 9/002; F28F 2275/085; F28F 2280/105
See application file for complete search history.

(56) References Cited

U.S. PATENT DOCUMENTS 3,954,238 A * 5/1976 Nivet ..... F16L 3/1075 248/68.1
4,095,646 A * 6/1978 Granetzke ..... F28F 9/00 165/166
(Continued)

FOREIGN PATENT DOCUMENTS

CN 1608195 A 4/2005
CN 104301472 A 1/2015
(Continued)

OTHER PUBLICATIONS

International Search Report and Written Opinion in corresponding International Application No. PCT/EP2018/071995, dated Oct. 31, 2018 (9 pages).
(Continued)

*Primary Examiner* — Devon Russell
(74) *Attorney, Agent, or Firm* — Osha Bergman Watanabe & Burton LLP

(57) ABSTRACT

A frame (100) for a heat exchanger (1), wherein the frame (100) comprises a first arm (110) and a second arm (120) connectable together in a first connection (141) and in a second connection (142), so that the arms (110, 120) form a loop for encircling the heat exchanger (1), wherein at least one of the arms (110, 120) is adapted to restrict the movement of the heat exchanger (1) with respect to the frame (100) in at least one direction after assembly, characterized in that the first connection (141) is detachable and the second connection (142) enables movement of the first arm (110) with respect to the second arm (120) when the first connection (141) is detached.

9 Claims, 8 Drawing Sheets

(51) Int. Cl.
*F28D 1/053* (2006.01)
*F28D 9/00* (2006.01)

(52) U.S. Cl.
CPC ..... *F28D 9/0037* (2013.01); *F28F 9/002* (2013.01); *F28F 2275/085* (2013.01); *F28F 2280/105* (2013.01)

(56) References Cited

U.S. PATENT DOCUMENTS 5,535,819 A * 7/1996 Matsuura ..... F28F 9/0224 165/149
6,974,383 B2 * 12/2005 Lewis ..... F24F 3/044 292/194
2008/0083093 A1 * 4/2008 Saltenberger ..... F16L 3/12 24/20 CW
2008/0135209 A1 * 6/2008 Lowe ..... B60K 11/08 165/77
2009/0045300 A1 * 2/2009 Vander Griend ..... F16L 3/1075 248/62

FOREIGN PATENT DOCUMENTS

CN 104565541 A 4/2015
CN 205137843 U * 4/2016
CN 205137843 U 4/2016
DE 19727610 A1 1/1999
DE 19727610 B4 * 4/2005 ..... F16L 3/1008

OTHER PUBLICATIONS

First Office Action in corresponding Chinese Application No. 201880063662.X, dated Feb. 26, 2021 (11 pages).
Second Office Action in corresponding Chinese Application No. 201880063662.X, dated Oct. 21, 2021 (12 pages).

* cited by examiner

FRAME FOR A HEAT EXCHANGER

FIELD OF THE INVENTION

The invention relates to a frame for a heat exchanger. More particularly, the invention relates to a frame for attaching the plate heat exchanger to an interface in a vehicle, for example a car.

BACKGROUND OF THE INVENTION

Heat exchangers for vehicles, for example cars, are commonly known in the art. An example of such heat exchanger is a liquid-cooled condenser, which comprises a core consisting of stacked corrugated inner plates forming a heat transfer surfaces, which plates all have the same or similar pattern and dimensions of corrugations. The plates may be extruded to form a pattern of bulges and recesses on their surface. Combining the plates into a stack or a packet in a leak-proof manner, for example by brazing, soldering or screwing between outer end panels, forms compartments between the plates with a system of channels that provide turbulent flow of a coolant or a refrigerant, respectively. The plates are also provided with openings made in appropriate places, which, after the sealing a packet of plates, form inlet and outlet channels for heat transfer media.

A heat exchanger must be mounted in the interior of the vehicle and connected to the circuits of appropriate fluids. The size and the connection possibilities of these exchangers are especially critical for the integration of the heat exchanger into the vehicle. In addition, ready accessibility to the connection between the heat exchanger and the rest of the circuits is sought in order to facilitate assembly and subsequent maintenance operations.

Many further requirements are placed on such attachment, stemming from both cost effectiveness and specific environment. For example, the connection of the heat exchanger to the vehicle should not be affected by shocks and vibrations. Space requirements also play a role, wherein placement with respect to other elements of vehicle in very limited space available makes an effective design of the connection arrangement a complicated effort. In addition, some vehicles are equipped with ready interfaces for attaching the heat exchanger units. Consequently, a heat exchanger unit must be designed to perform its function while being compatible with specific, often very strict interface requirements.

The above-mentioned problems need to be addressed while designing a connection arrangement for connecting a heat exchanger in a vehicle.

The presented invention aims at solving the above-mentioned problems.

SUMMARY OF THE INVENTION

The object of the invention is, among others, a frame for a heat exchanger, wherein the frame comprises a first arm and a second arm connectable together in a first connection and in a second connection, so that the arms form a loop for encircling the heat exchanger, wherein at least one of the arms is adapted to restrict the movement of the heat exchanger with respect to the frame in at least one direction after assembly, wherein the first connection is detachable and the second connection enables movement of the first arm with respect to the second arm when the first connection is detached.

Advantageously, the loop forms a shape complementary with perimeter of the heat exchanger.

Advantageously, the second connection is a hinged connection.

Advantageously, the first connection is adapted to retain further elements of the heat exchanger.

Advantageously, the second connection is detachable.

Advantageously, the second connection is formed by a shaft located on the first arm and a complementary, arched receiving part on the second arm.

Advantageously, the hinged connection is a slot located in the first arm, coupled with a T-shaped plate on the second arm.

Advantageously, the second connection is an integral, elastic connection.

Another object of the invention is a heat exchanger assembly comprising a heat exchanger and a frame as described herein.

BRIEF DESCRIPTION OF DRAWINGS

Examples of the invention will be apparent from and described in detail with reference to the accompanying drawings, in which.

DETAILED DESCRIPTION OF EMBODIMENTS

Figure 1:
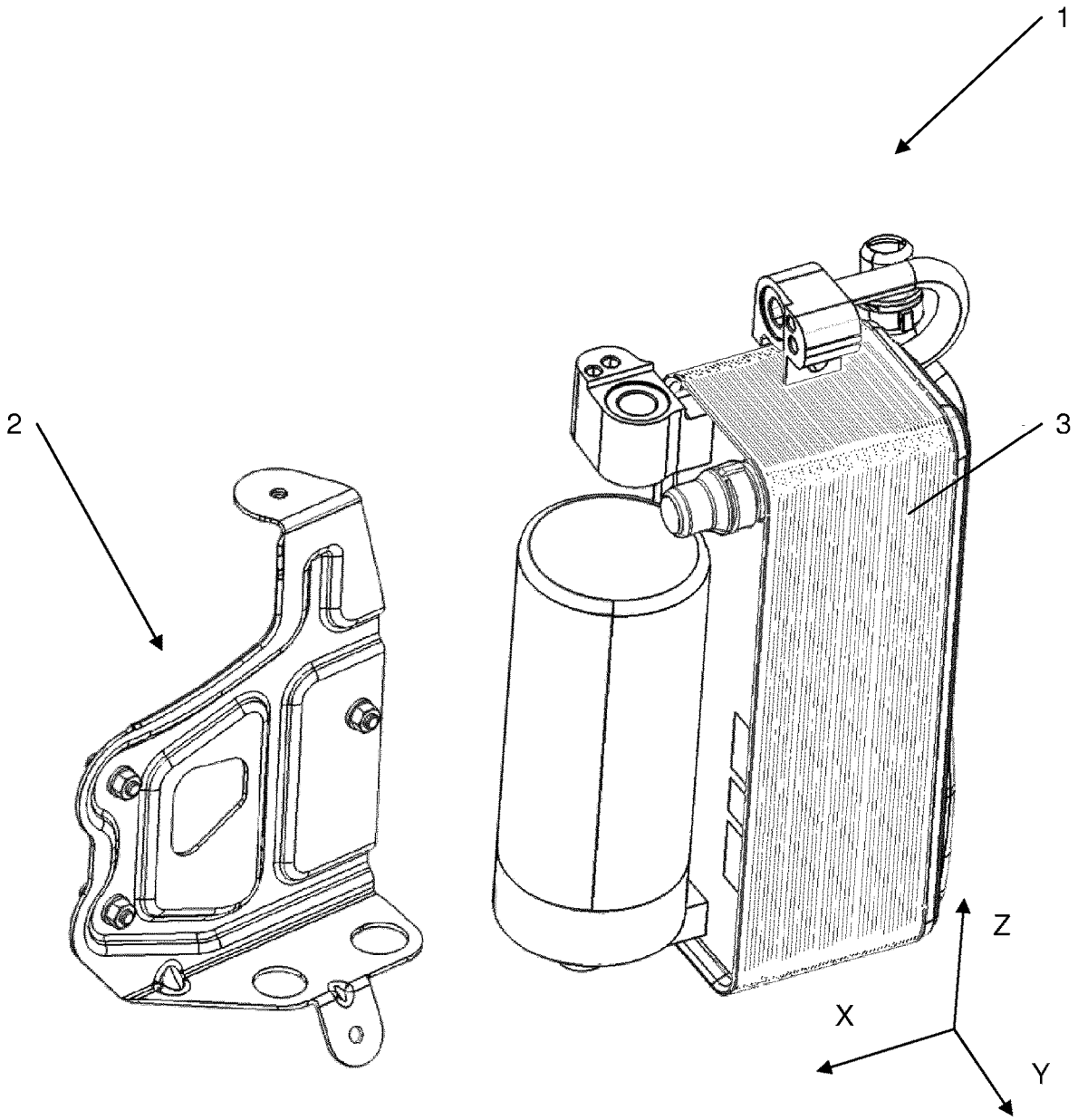
FIG. 1 shows a heat exchanger and an interface for the heat exchanger.

FIG. 1 shows a heat exchanger 1 and an interface 2 for the heat exchanger. The interface 2 can be a bracket, which is designed to be attached to the vehicle frame, for example a car frame. An example of heat exchanger is a liquid-cooled condenser, which comprises a core 3 consisting of stacked corrugated inner plates forming a heat transfer surfaces, which plates all have the same or similar pattern and dimensions of corrugations. The heat exchanger can be described with reference to a coordinate system, with axis Z denoting a vertical direction, axis X denoting a longitudinal direction, and axis Y lateral direction.

Figure 2:
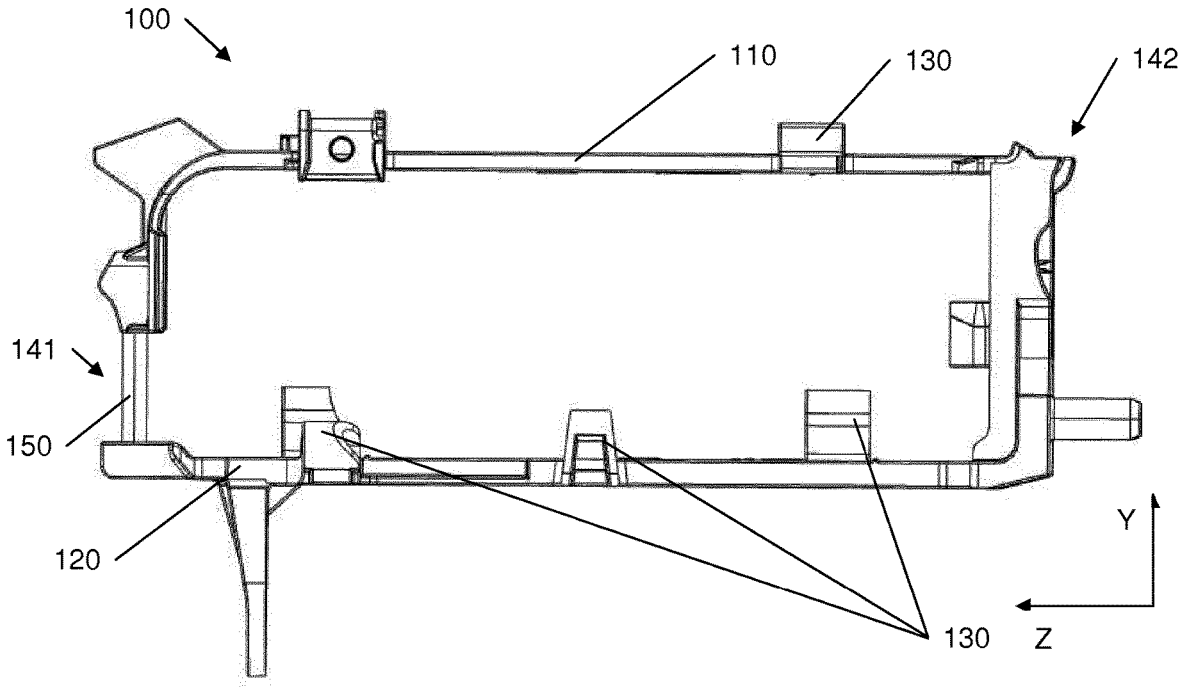
FIGS. 2 and 3 show a frame according to the invention in the first embodiment.
Figure 3:
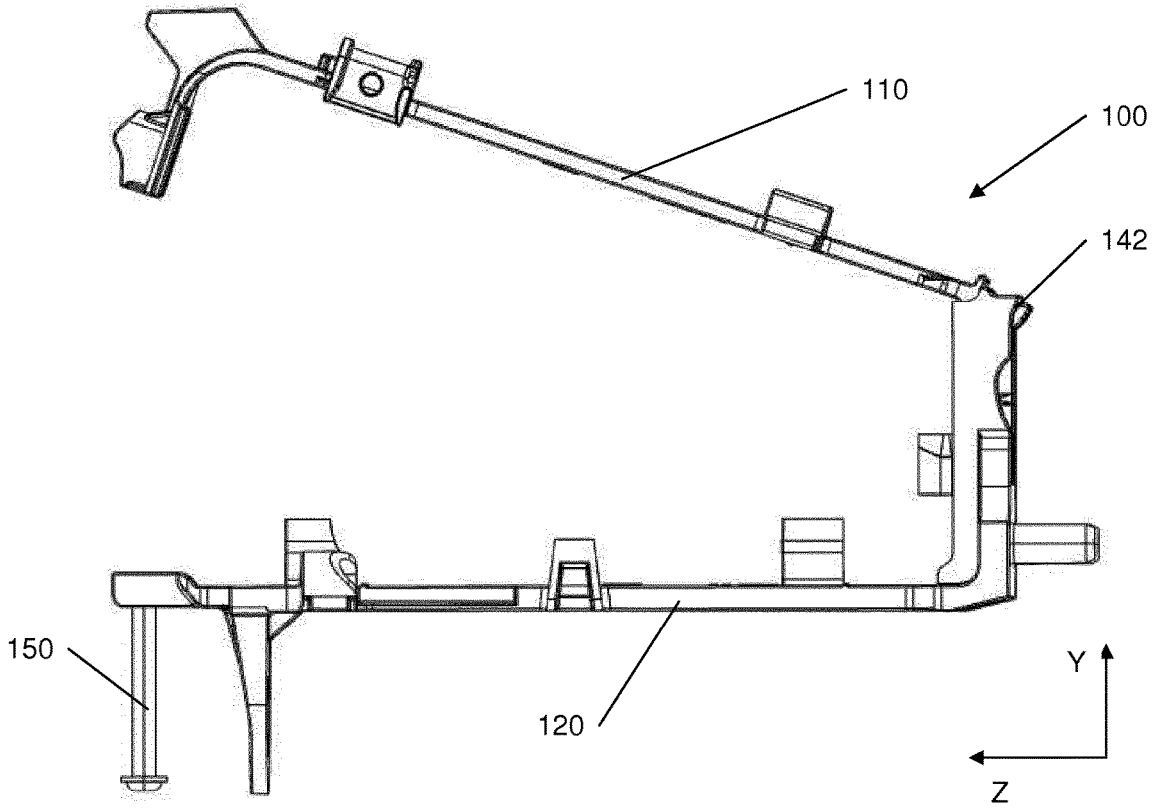

FIGS. 2 and 3 show a frame 100 according to the invention in a first embodiment. The frame 100 serves as means for attaching the heat exchanger 1 to an interface 2 in a vehicle. It can also serve as means for attaching the heat exchanger 1 directly to the vehicle. The frame 100 comprises a first arm 110 and a second arm 120. In FIG. 2, the first arm 110 and the second arm 120 are connected to each other so that they form a loop for encircling the heat exchanger, in particular the core of the heat exchanger. More particularly, a first arm 110 and a second arm 120 are connected together in a first connection 141 and in a second connection 142. At least one of the arms 110, 120 is adapted to restrict the movement of the heat exchanger 1 with respect to the frame 100 after assembly. This is for example achieved by loop of the frame 100 following the perimeter of the core 3. In particular, the loop can form a shape complementary with perimeter of the heat exchanger, along the whole perimeter or only along selected parts of it. The perimeter of the heat exchanger can be for example a perimeter of the plates comprised in a plate heat exchanger. One or both of the arms 110, 120 can have a shape complementary with respect to this core 3, and at the same time be in contact with the core 3. Preferably, both arms 110, 120 have a shape complementary with the core 3 of the heat exchanger 1. FIG. 2 shows the frame 100 in a closed configuration. The free ends of the arm 110, 120 can be fixed to each other by attachment means 150 in the first connection 141. The first connection 141 is detachable. The attachment means 150 can be for example a screw. The loop of the frame 100 encompasses the heat exchanger along its side walls. FIG. 3 shows the frame 100 in an opened configuration. As can be seen, in connection 142, there is a hinged connection between the first arm 110 and the second arm 120, which allows a movement of the first arm 110 with respect to the second arm 120, preferably in a pivotable manner, when the first connection 141 is detached. This facilitates manufacturing of the heat exchanger assembly, as well as enables easy replacement of the elements, for example for servicing. The core of the heat exchanger can be introduced and/or removed along the Z axis, which is advantageous in a limited space of difficult access capabilities.

Figure 4:
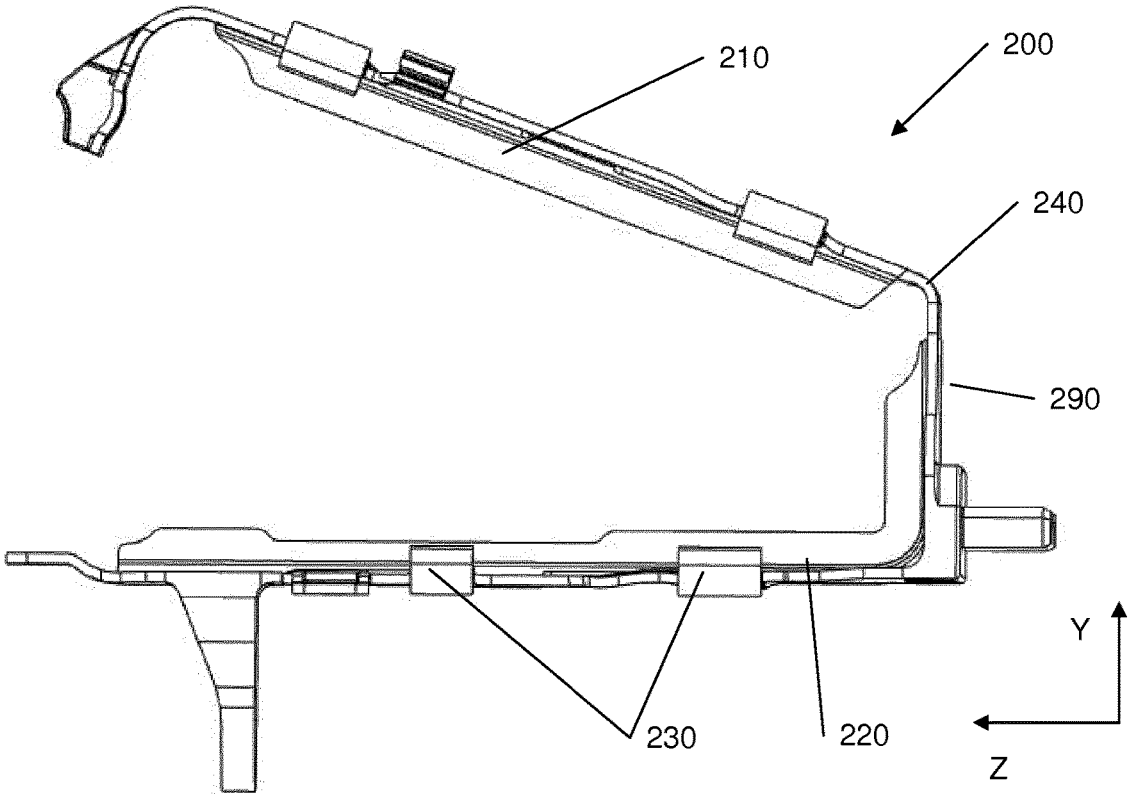
FIG. 4 shows a frame according to the invention in the second embodiment.

FIG. 4 shows a frame according to the invention in the second embodiment. In this embodiment, the first arm 210 and the second arm 220 are connected integrally by an elastic connection 240. Consequently, the first arm 210 and the second arm 220 form together a single part which constitutes the frame 200. The frame 200 opens by deflecting (pivoting) the first arm 210 from the second arm 220 to allow introduction of the core 3 along Z axis. Such connection allows production of the frame as a single element. The material which can be used in this case can be plastic.

Figure 5:
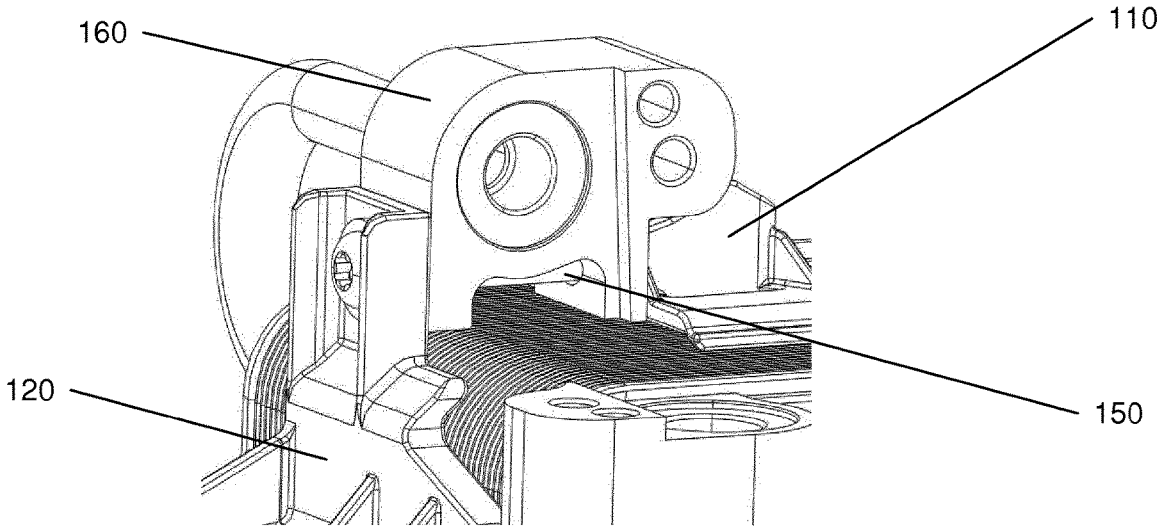
FIG. 5 shows details of a connection between the free ends of the frame.

FIG. 5 shows details of the first connection 141 between the free ends of the arms 110, 120 of the frame 100. Preferably, the attachment means 150 are configured to connect an intermediate element in-between the free ends of the frame arms 110, 120 and to retain it with respect to the frame 1 and consequently the whole heat exchanger assembly. In particular, attachment means 150 further serve to connect to element 160, which in this case is a connector. As a consequence, upon connecting further elements to this connector, it will be securely held with respect to the core even in case of excessive force used for attaching it.

Figure 6:
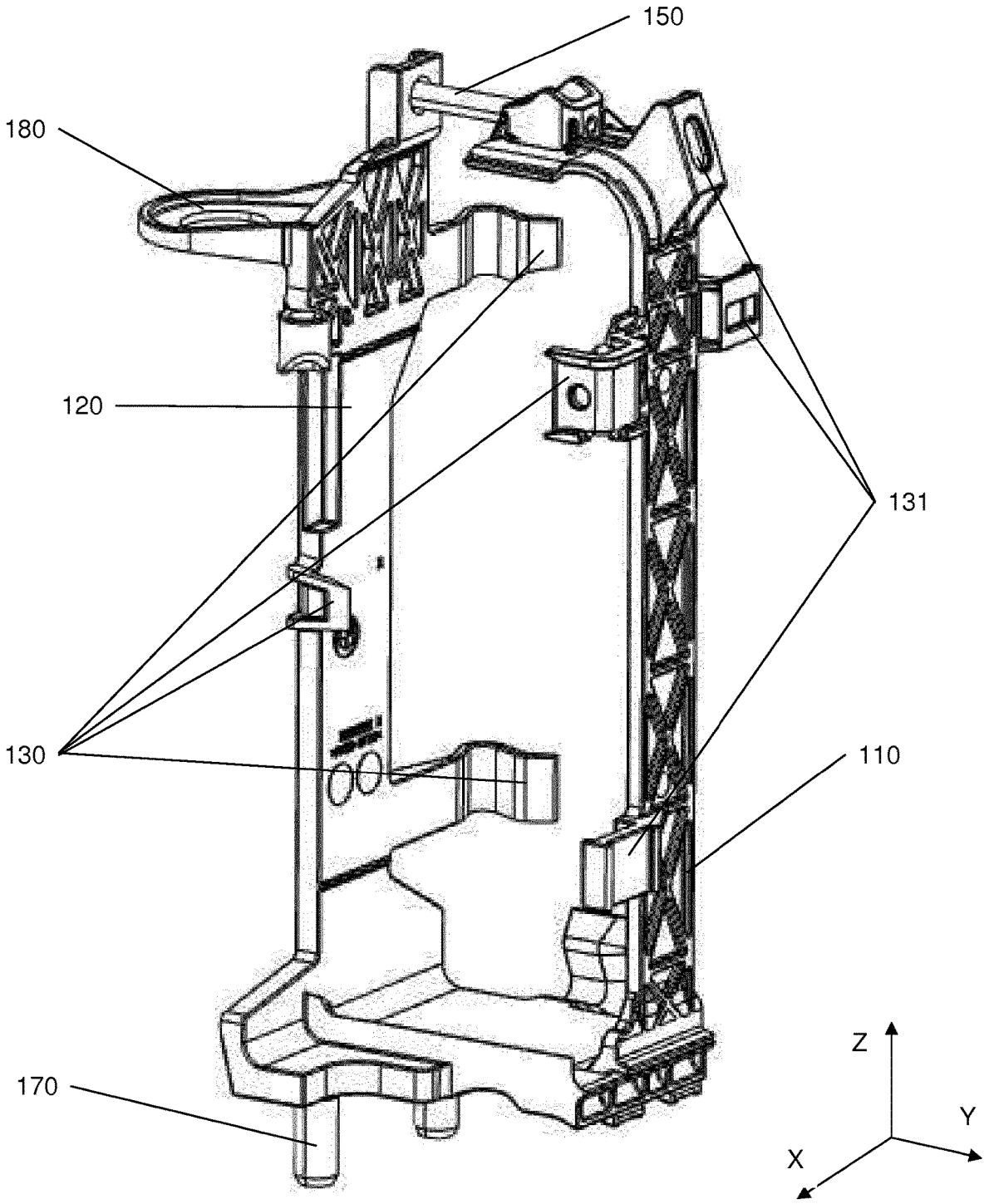
FIG. 6 shows a frame in the first embodiment in a perspective view.

FIG. 6 shows a frame in the first embodiment in a perspective view. The frame 100 can further comprise interface attachment means 170. For example, the second arm 120 can comprise the interface attachment means 170 in form of pins, which during the assembly are inserted into corresponding openings in the interface plate 2. Further, the frame 100 can comprise blocking elements 130, which serve to hold the core 3. In other words, the blocking elements 130 restrict the movement of the core 3 of the heat exchanger 1 in a further direction, for example along the axis Z. The blocking elements 130 can also be adapted to serve as connection points for further elements of the heat exchanger assembly, for example brackets for holding a bottle. The frame 100 can further comprise auxiliary attachment elements 131, which can serve as attachment points for holding and/or attaching further elements of the heat exchanger assembly, like for example cables, which for example are led parallel to the core.

The frame 100 can further comprise interface attachment means 180 in form of an opening near the first connection 140.

Figure 7:
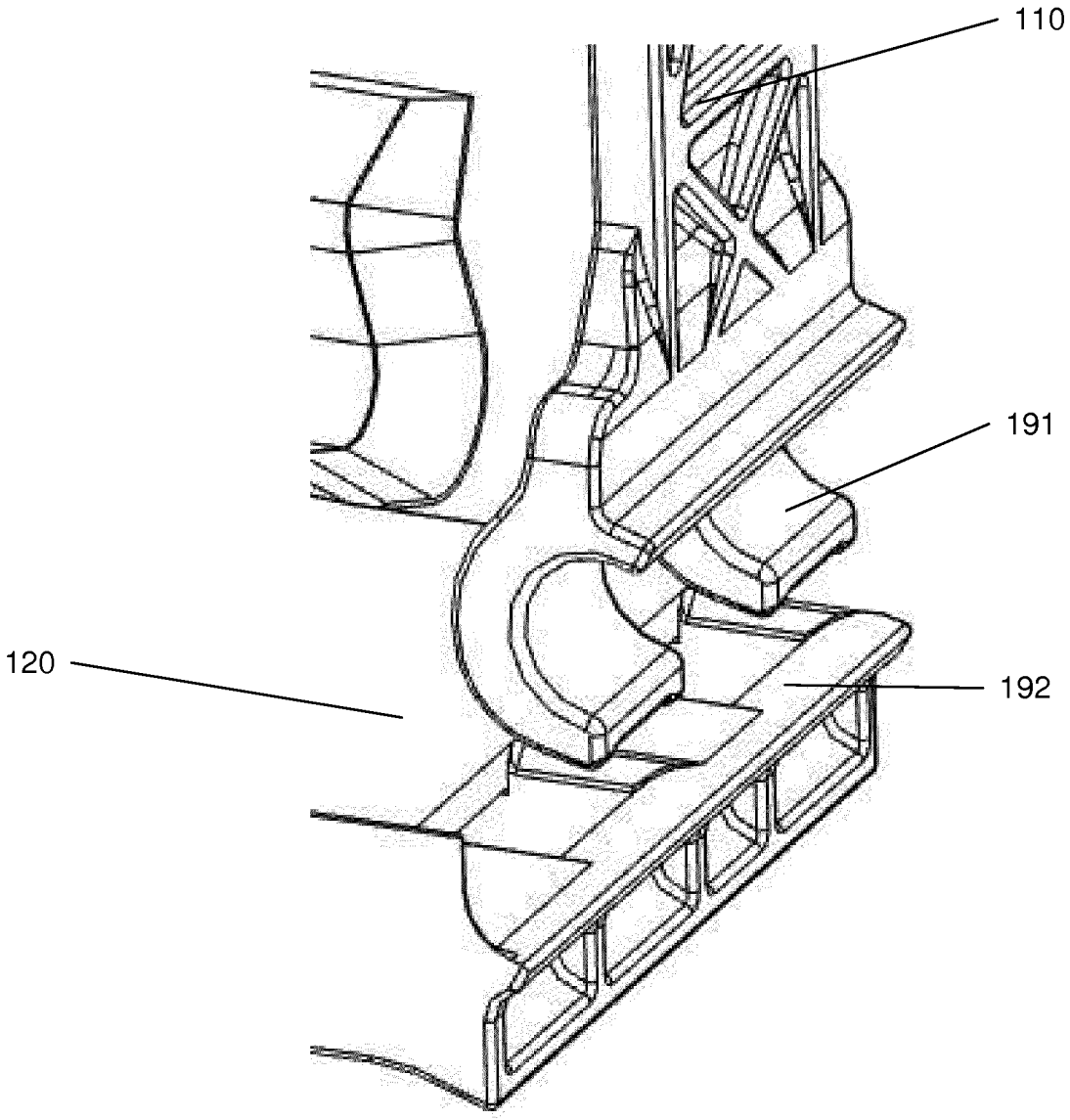
FIG. 7 shows details of an example of hinged connection.
Figure 8:
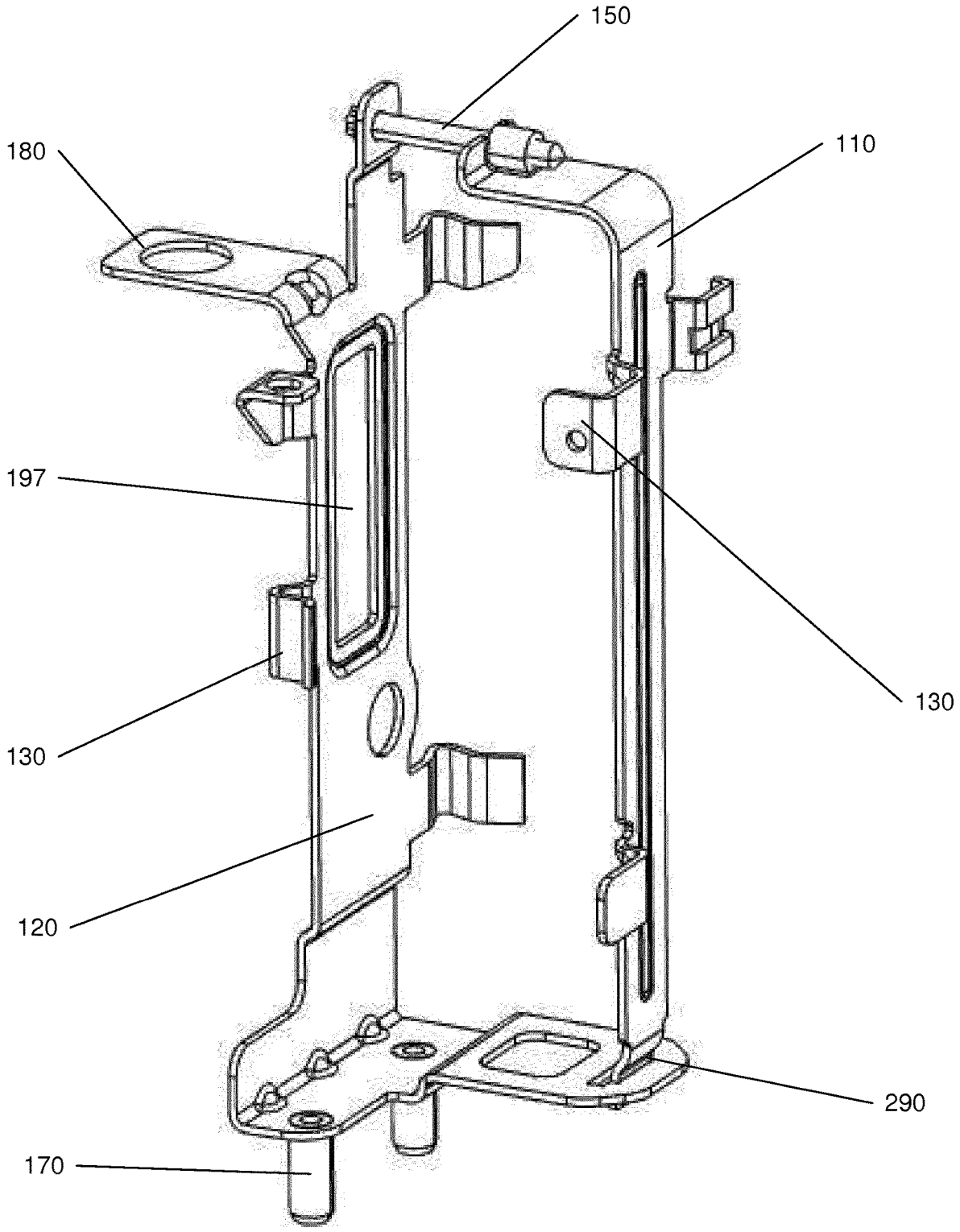
FIG. 8 shows a frame in a further embodiment in a perspective view.

FIG. 7 shows details of an example of hinged connection constituting the second connection 142. In this example, the hinged connection comprises a tubular element 192 located on the second arm 120 and a complementary, arched receiving part 191 on the first arm 110. The receiving part 191 is detachable from the tubular element 192. This facilitates assembly of the arms 110, 120 on the core 2, as well as allows to assemble the frame if it is made from more parts, for example two parts. Preferably, the receiving element 191 comprises two arms distanced from each other with a free space in-between. Accordingly, the tubular element 192 has two tubular sections separated from each other by a bridge for connecting the middle section of the tubular element 192 with the rest of the arm 120. This allows to stabilize the first arm 110 with respect to the second arm 120. The bridge stabilizes the whole assembly. FIG. 8 shows a frame in a further embodiment in a perspective view. It differs from the first embodiment in that the hinged connection 290 is of different form, as it will be further explained below. The frame can be made of steel or aluminium, which allows to produce them by means of forming processes.

Figure 9:
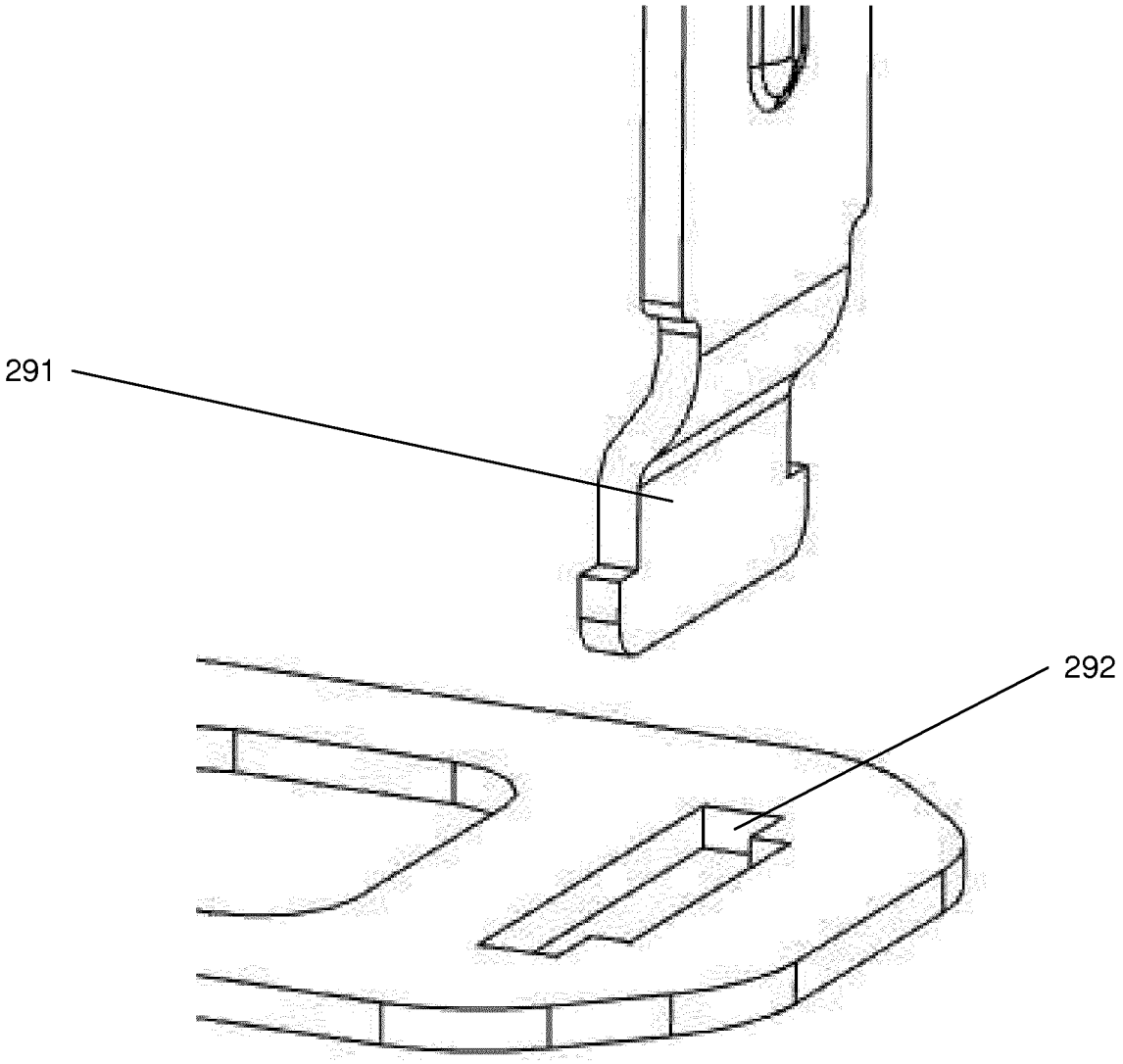
FIG. 9 shows details of an another example of hinged connection.

FIG. 9 shows details of the hinged connection 290. The shaped plate 291, for example a T-shaped plate, cooperates with a slot 292. The slot 292 is configured to receive the shaped plate 291 and to retain it, while allowing a hinging movement of the arms. This is done for example by providing the slot 292 with two differently sized opening portions which are connected to each other. The shaped plate 291 can be inserted into the first opening portion and then moved into the second opening portion, in which it is held by the arms of the T-shaped plate 291. It is however able to effect a hinging movement of the first arm 110 with respect to the second arm 120 without escaping the slot 292. Two side arms of the shaped plate 291 abut the side walls of the second opening portion. They can however move freely through the first opening portion of the slot 292. Consequently, the arms 110, 120 are connected hingably in a simple and cost effective manner, which also allows simple disconnection.

Figure 10:
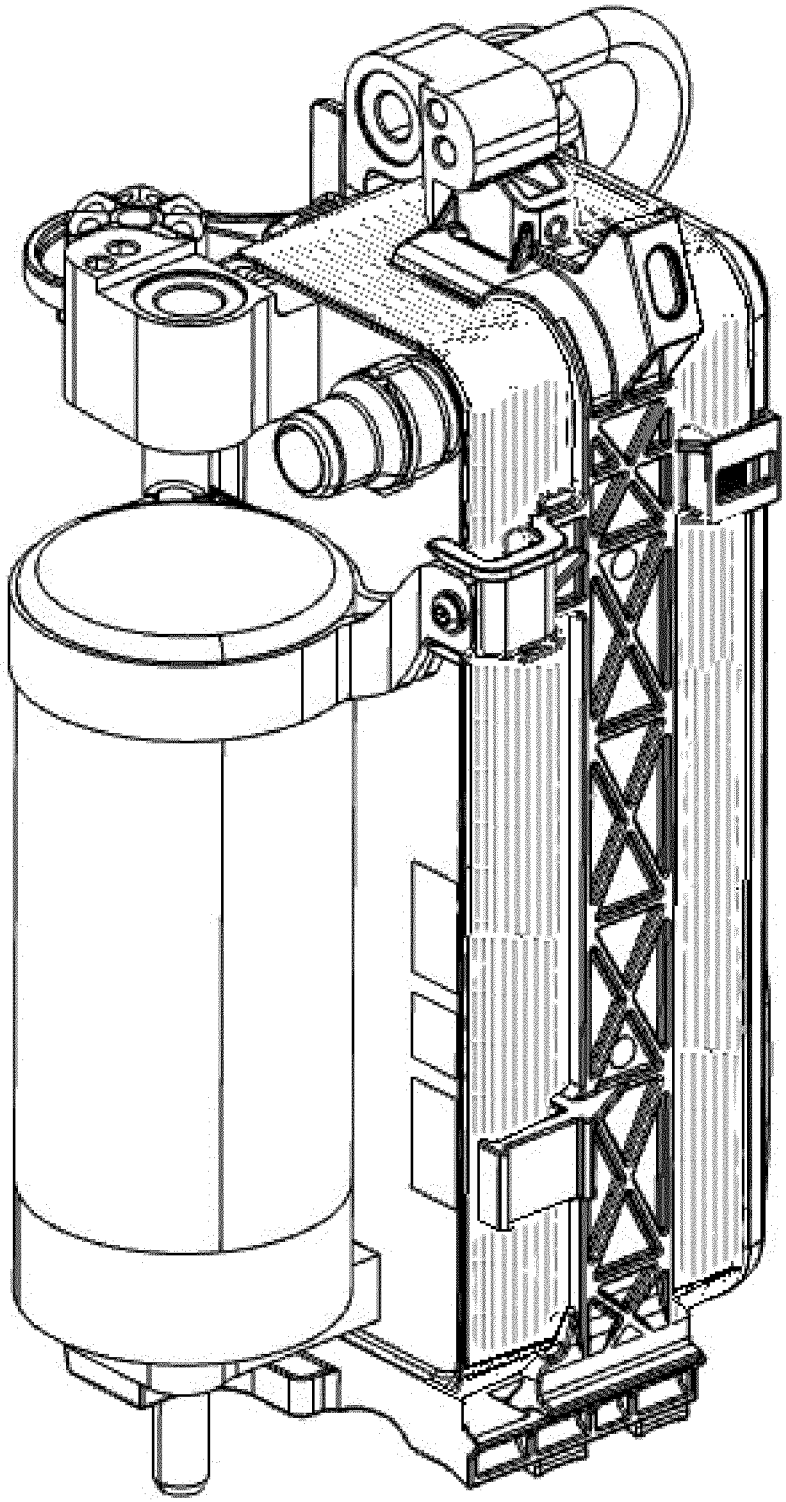
FIG. 10 shows an exemplary heat exchanger with frame according to the invention.

FIG. 10 shows an exemplary heat exchanger with frame according to the invention. As can be seen, the frame according to the invention provides means for attaching the heat exchanger to a vehicle in a secure manner, which at the same time provide for improved manufacturing and serviceability of the heat exchanger assembly.

Further, the frame can be adapted to make use of existing elements of the heat exchanger for attachment, which further improves rigidity of the assembly.

The invention claimed is:

1. A frame for a plate heat exchanger including a core with stacked plates, the frame comprising:

a first arm and a second arm connectable together in a first connection and in a second connection, so that the arms form a loop for encircling the stacked plates of the core of the heat exchanger, wherein the loop forms a shape complementary with a perimeter of the stacked plates of the core of the heat exchanger, wherein at least one of the arms is adapted to restrict the movement of the heat exchanger with respect to the frame in at least a first direction and a second direction after assembly, the first and second directions being orthogonal with respect to one another, wherein the first connection is detachable and the second connection enables movement of the first arm with respect to the second arm when the first connection is detached.

2. The frame according to claim 1, wherein the second connection is a hinged connection.

3. The frame according to claim 1, wherein the second connection is detachable.

4. The frame according to claim 1, wherein the second connection is formed by a shaft located on the first arm and a complementary, arched receiving part on the second arm.

5. The frame according to claim 2, wherein the hinged connection is a slot located in the first arm, coupled with a T-shaped plate on the second arm.

6. The frame according to claim 1, wherein the second connection is an integral, elastic connection.

7. The frame according to claim 1, wherein the first connection is adapted to retain further elements of the heat exchanger.

8. A heat exchanger assembly comprising:

a plate heat exchanger including a core with stacked plates; and a frame comprising:

a first arm and a second arm connectable together in a first connection and in a second connection, so that the arms form a loop for encircling the stacked plates of the core of the heat exchanger, wherein the loop forms a shape complementary with a perimeter of the stacked plates of the core of the heat exchanger, wherein at least one of the arms is adapted to restrict the movement of the heat exchanger with respect to the frame in at least a first direction and a second direction after assembly, the first and second directions being orthogonal with respect to one another, wherein the first connection is detachable and the second connection enables movement of the first arm with respect to the second arm when the first connection is detached.

9. A frame for a plate heat exchanger including a core with stacked plates, the frame comprising:

a first arm and a second arm connectable together in a first connection and in a second connection, so that the arms form a loop for encircling the stacked plates of the core of the heat exchanger, wherein the loop forms a shape complementary with a perimeter of the stacked plates of the core of the heat exchanger and the arms are in contact with the core, wherein at least one of the arms is adapted to restrict the movement of the heat exchanger with respect to the frame in at least a first direction and a second direction after assembly, the first and second directions being orthogonal with respect to one another, wherein the first connection is detachable and the second connection enables movement of the first arm with respect to the second arm when the first connection is detached, the frame being for attaching the heat exchanger to an interface of a motor vehicle.

* * * * *